US005825902A

United States Patent [19]

Fujishima

[11] Patent Number: 5,825,902

[45] Date of Patent: Oct. 20, 1998

[54] SPHERICAL PIEZOELECTRIC SPEAKER

[75] Inventor: Satoru Fujishima, Mukou, Japan

[73] Assignee: Murata Manufacturing Co., Ltd., Kyoto-fu, Japan

[21] Appl. No.: 725,000

[22] Filed: Oct. 1, 1996

[30] Foreign Application Priority Data

Oct. 6, 1995 [JP] Japan ..... 7-296327
Jun. 28, 1996 [JP] Japan ..... 8-169890

[51] Int. Cl.[6] ..... H04R 25/00

[52] U.S. Cl. ..... 381/190; 381/423

[58] Field of Search ..... 381/114, 173, 381/190, 202, 423, 429, 430; 310/334, 371, 800, 326

[56] References Cited

U.S. PATENT DOCUMENTS 2,939,970 6/1960 Dranetz et al. ..... 381/173
3,708,702 1/1973 Brunnert et al. ..... 381/190
4,440,983 4/1984 Facoetti et al. ..... 381/190
4,843,275 6/1989 Radice ..... 381/190
4,866,683 9/1989 Phillips ..... 381/190

FOREIGN PATENT DOCUMENTS 0614555 7/1978 U.S.S.R. ..... 381/190

*Primary Examiner*—Huyen Le
*Attorney, Agent, or Firm*—Graham & James LLP

[57] ABSTRACT

A spherical piezoelectric speaker having a small and simple structure, a wide sound frequency range and a high sound pressure includes a spherical shell piezoelectric ceramic body which is hollow inside and an external electrode and an internal electrode defining a driving device for oscillating the spherical shell piezoelectric ceramic body. A sound absorber is provided in a hollow section of the piezoelectric ceramic body and a frame for holding the piezoelectric ceramic body is disposed on the outer surface of the piezoelectric ceramic body via dampers for reducing an influence of external oscillation.

19 Claims, 7 Drawing Sheets

SPHERICAL PIEZOELECTRIC SPEAKER

BACKGROUND OF THE INVENTION

1. Field of the Invention

The present invention relates to a spherical piezoelectric speaker.

2. Description of Related Art

FIG. 11 shows a prior art piezoelectric speaker. As shown in FIG. 11, the prior art piezoelectric speaker 20 comprises a mono-morph or bi-morph circular piezoelectric ceramic plate 10, a frame 11 for supporting a peripheral portion of the piezoelectric ceramic plate 10, a paper cone 12 provided so as to contact approximately with the center of the piezoelectric ceramic plate 10 and to diverge radially and a speaker box 13 disposed in contact with the frame 11 and the paper cone 12.

This piezoelectric speaker 20 functions as a speaker when an electrical signal is applied to the circular piezoelectric ceramic plate 10 to cause oscillation which is transmitted to the paper cone 12 to emit sound from the front side of the paper cone 12 via an opening (not shown) of the speaker box 13.

However, the prior art piezoelectric speaker described above has experienced the following problems. That is, because the sound output from the front side of the paper cone and the sound output from the backside of the paper cone cancel each other, thus decreasing the output of the sound in the prior art piezoelectric speaker, the speaker box and a baffle board are attached to the paper cone to use only the sound from the front side as the output sound of the speaker. As a result of this structure, the overall size of the speaker has been increased and its structure has become increasingly complex.

Further, because only the sound from the front side of the paper cone has been used, the output of the sound itself has been relatively low.

SUMMARY OF THE INVENTION

To overcome the problems described above, the preferred embodiments of the present invention provide a spherical piezoelectric speaker which is adapted to eliminate the aforementioned problems.

In order to overcome the problems described above, a spherical piezoelectric speaker of the preferred embodiments of the present invention comprises a spherical shell piezoelectric ceramic body which is polarized in a thickness direction thereof and is hollow inside; and a driving device for generating sound by oscillating the piezoelectric ceramic body.

Further, a spherical piezoelectric speaker of the preferred embodiments of the present invention comprises a spherical shell piezoelectric ceramic body which is polarized in a thickness direction thereof and is hollow inside; a sound absorber provided within the hollow section of the piezoelectric ceramic body; a plurality of dampers and a frame provided on the outside of the piezoelectric ceramic body; an external electrode disposed on an outer surface of the piezoelectric ceramic body; and an internal electrode disposed on an inner surface of the piezoelectric ceramic body; and the spherical piezoelectric speaker generates sound by oscillating the piezoelectric ceramic body by inputting a driving signal between the external electrode and the internal electrode.

Thereby, when a driving signal is applied to the spherical shell piezoelectric ceramic body, the spherical shell piezoelectric ceramic body causes respiratory oscillation radially from the center thereof. The phrase "respiratory oscillation" means that the spherical shell element as a whole undergoes periodic contractions and expansions. Due to that, all of the sound waves output from the surface of the piezoelectric ceramic body have the same phase.

Further, because sound waves output from the inner surface of the piezoelectric ceramic body are absorbed by the sound absorber and will not cancel sound waves output from the outer surface of the piezoelectric ceramic body, the overall output sound of the entire speaker is increased.

In addition, because the speaker box and other parts which have been necessary in the prior art are not necessary, the speaker may be miniaturized.

The specific nature of the preferred embodiments of the present invention, as well as other objects, uses and advantages thereof, will be apparent from the description and from the accompanying drawings.

DETAILED DESCRIPTION OF PREFERRED EMBODIMENTS

One preferred embodiment for carrying out the present invention will be explained below with reference to the drawings.

Figure 1:
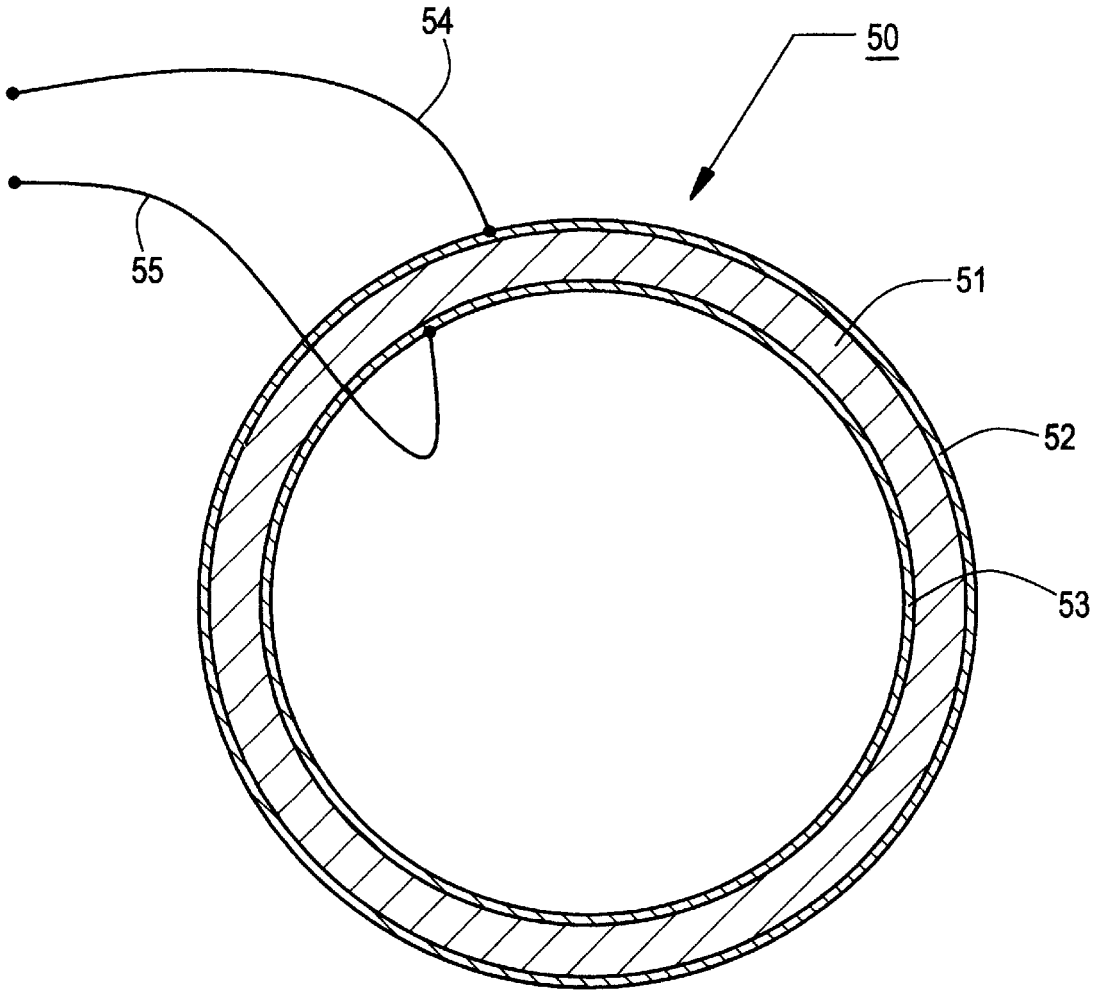
FIG. 1 is a section view showing a structure of a spherical piezoelectric speaker according to one preferred embodiment of the present invention.

FIG. 1 shows a spherical piezoelectric speaker 50 according to one preferred embodiment of the present invention. The spherical piezoelectric speaker 50 preferably comprises a spherical shell piezoelectric ceramic body 51 which is hollow inside and an external electrode 52 and an internal electrode 53 defining a driving device for oscillating the piezoelectric ceramic body 51, disposed respectively on outer and inner surfaces of the spherical shell piezoelectric ceramic body 51. The piezoelectric ceramic body 51 preferably has been polarized in a direction of thickness thereof via the external electrode 52 and the internal electrode 53.

It is preferable to use a material having a high electromechanical coupling coefficient, such as PZT system piezoelectric ceramic material, for the piezoelectric ceramic body 51. However, other piezoelectric materials may also be used. For the external electrode 52 and the internal electrode 53, typical electrode materials such as silver, silver-palladium, silver-platinum, gold and copper are preferably used. The electrodes are preferably formed by way of sputtering, plating or printing and sintering conductive paste or other suitable electrode forming processes.

The external electrode 52 and the internal electrode 53 are connected respectively with one end of each of lead terminals 54 and 55 whose other terminals are connected with a driving unit not shown. The spherical piezoelectric speaker 50 functions as a speaker when a driving signal is supplied from the driving unit to the piezoelectric ceramic body 51 to oscillate the piezoelectric ceramic body 51 to generate and radiate sound waves from the outer and inner surfaces of the piezoelectric ceramic body 51.

At this time, the spherical shell piezoelectric ceramic body 51 oscillates symmetrically and radially about the center of sphere as a respiratory sphere, thus propagating the sound wave in all directions.

Next, a spherical piezoelectric speaker 60 as another preferred embodiment of the present invention will be explained with reference to FIGS. 2 and 3.

Figure 2:
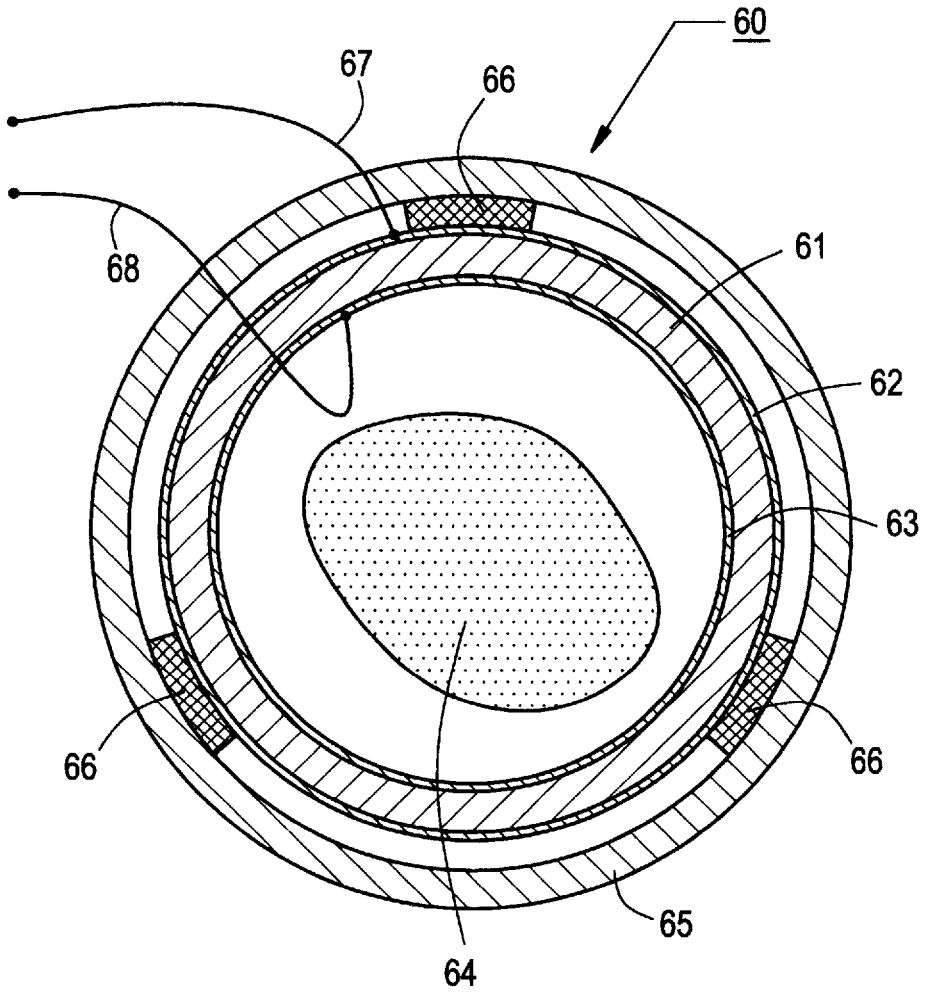
FIG. 2. is a section view showing a structure of a spherical piezoelectric speaker according to another preferred embodiment of the present invention.
Figure 3:
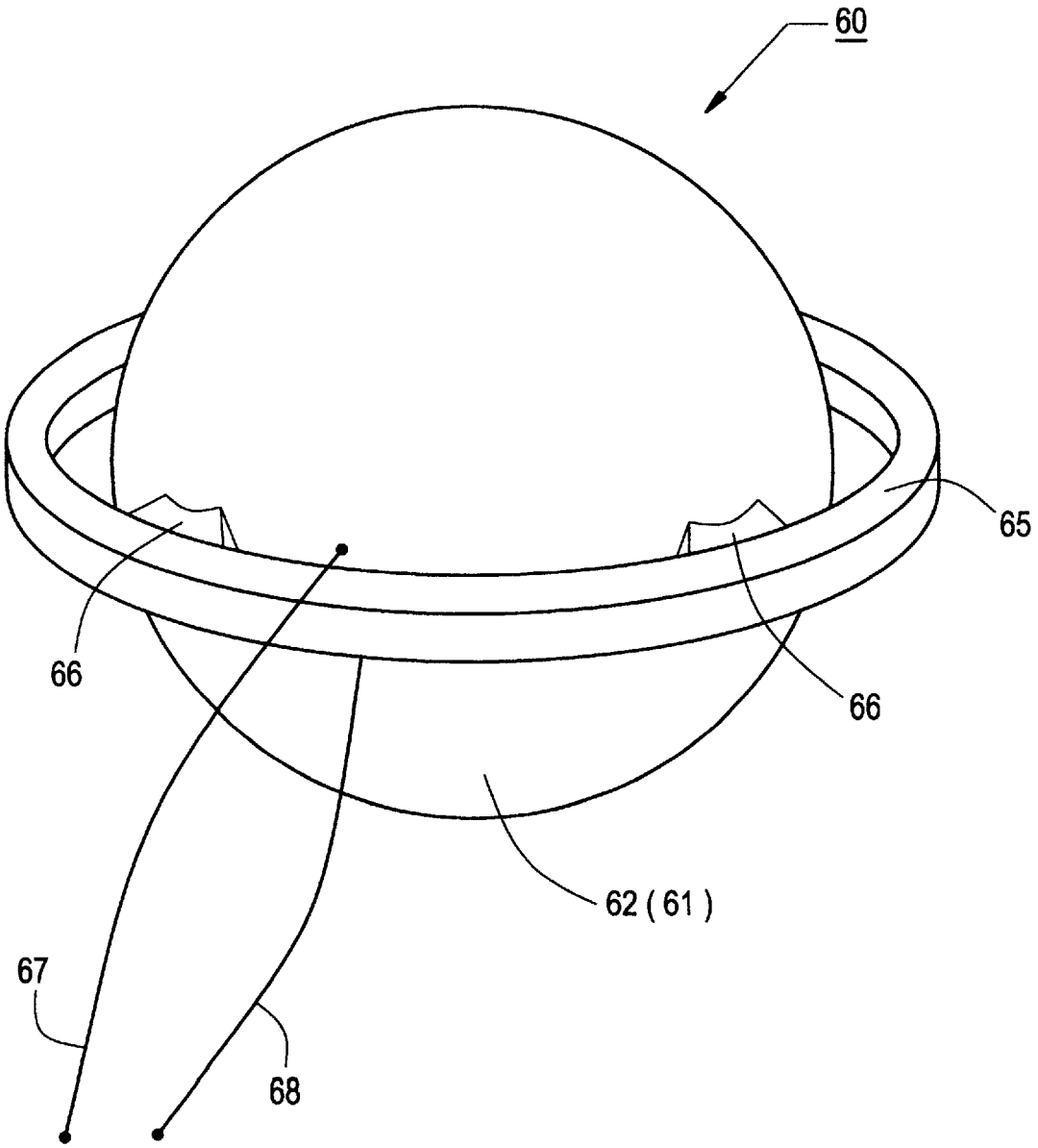
FIG. 3 is a perspective view showing the structure of the spherical piezoelectric speaker shown in FIG. 2.

In FIGS. 2 and 3, the spherical piezoelectric speaker 60 comprises a spherical shell piezoelectric ceramic body 61 which is preferably hollow inside and an external electrode 62 and an internal electrode 63 defining a driving device for oscillating the spherical shell piezoelectric ceramic body 61, disposed respectively on outer and inner surfaces of the spherical shell piezoelectric ceramic body 61. The piezoelectric ceramic body 61 preferably has been polarized in a direction of thickness thereof via the external electrode 62 and the internal electrode 63. A sound absorber 64 is preferably provided in the hollow section of the piezoelectric ceramic body 61 and a frame 65 for holding the piezoelectric ceramic body is disposed on the outer surface of the piezoelectric ceramic body 61 via a plurality of dampers 66 for reducing the influence of external oscillation.

It is preferable to use a material having a high electromechanical coupling efficiency, such as a PZT system piezoelectric ceramics, for the piezoelectric ceramic body 61. However, other piezoelectric material may be used to form the piezoelectric ceramic body 61. For the external electrode 62 and the internal electrode 63, typical electrode materials such as silver, silver-palladium, silver-platinum, gold and cooper are preferably used. The electrodes are preferably formed by way of sputtering, plating, or printing and sintering conductive paste or other suitable electrode forming processes. For the sound absorber 64, a glass wool material, for example, is used. However, many other sound absorbing materials may also be used alone or in combination. The dampers 66 may be made of a material which absorbs impact without transmitting unnecessary oscillations generated in the frame 65 to the piezoelectric ceramic body 61. For example, dampers 66 made of rubber or having a spring-like shape and formed of elastic material may preferably be used. For the frame 65, a material which hardly causes unnecessary oscillation such as a high-density metallic material or a robust material having an elasticity such as a silicon rubber is preferably used.

In the spherical piezoelectric speaker 60 shown in the preferred embodiment of FIGS. 2 and 3, the external electrode 62 and the internal electrode 63 are connected respectively with one end of each of lead terminals 67 and 68 whose other terminals are connected with a driving unit not shown. The spherical piezoelectric speaker 60 functions as a speaker when a driving signal is supplied from the driving unit to the piezoelectric ceramic body 61 to oscillate the piezoelectric ceramic body 61 to generate and radiate sound waves from the outer and inner surfaces of the piezoelectric ceramic body 61.

At this time, the spherical shell piezoelectric ceramic body 61 oscillates symmetrically and radially about the center of the sphere as a respiratory sphere. Here, because the sound waves generated from the inner surface are absorbed by the sound absorber 64, a phase of each of the sound waves generated from the outer surface is always constant and uniform so long as a distance from the center is equal and the sound waves are radiated in all directions.

Next, the principle of the inventive spherical piezoelectric speaker will be explained below.

At first, assume a respiratory oscillation of a spherical shell having a radius of a and a thickness of t and that the thickness t is sufficiently thinner than the radius a ($t<a$). Considering a spherical coordinate system of $r\theta\phi$ here, a stress in the radial direction may be considered to be zero, so that a piezoelectric basic equation may be given by the following equations (1) and (2):

$$S_{\theta\theta}=(s_{11}^{E}+s_{12}^{E})T_{\theta\theta}+d_{31}E_r \tag{1}$$

$$D_r=2d_{31}T_{\theta\theta}+\in_{33}^{T}E_r \tag{2}$$

where, (S) is a strain, (T) a stress, (E) and electric field, (D) an electric flux density, (s) a compliance, (∈) a dielectric coefficient, and (d) a piezoelectric constant.

Next, an equation of motion when a pressure p having angular frequency ω is supplied to the spherical shell is given by the following equation (3):

$$-2tT_{\theta\theta}/a+p\omega^2tu=-p \tag{3}$$

where, u is displacement.

When a charge per unit area is assumed to be q here, electro-acoustic basic equations as expressed by the following equations (4) and (5) may be obtained from the equations (1) and (2):

$$p=Z_m\upsilon-AV \tag{4}$$

where, υ is sound velocity of the spherical shell.

$$I=A\upsilon+j\omega C_dV \tag{5}$$

where, I is current, V is voltage, $Z_m$ is a mechanical impedance, A is a force factor, and $C_d$ is a control capacity. Here, as for a resonance frequency, because $Z_m$ becomes zero, the following equation (6) holds:

$$f_r=\frac{1}{2\pi a}\sqrt{\frac{2}{\rho(s_{11}^{E}+s_{12}^{E})}} \tag{6}$$

where, ρ is the density of the ceramic material.

When a Young's modulus E and Poisson's ratio σ are used in the equation (6), the following equation (7) holds:

$$f_r = \frac{1}{2\pi a} \sqrt{\frac{2}{1-\sigma} \frac{E}{\rho}} \tag{7}$$

That is, a simple equation indicating that the resonance frequency of the spherical shell piezoelectric ceramic body is inversely proportional to the radius may be obtained.

Next, considering sound waves radiated from the respiratory motion of the spherical shell and assuming a velocity potential of the sound wave as $\phi$, the following wave equation (8) holds:

$$\frac{1}{r^2} \frac{d}{dr}\left(r^2 \frac{d\phi}{dr}\right) + (\omega/v_0)^2\phi = 0 \tag{8}$$

Because this solution is composed of only progressive waves, the equation (8) may be reduced to the following equation (9):

$$\phi = \frac{K}{r} \exp(-j\omega r/v_0) \tag{9}$$

where, $\upsilon_0$ is a sound velocity of air and K is a constant. Accordingly, a radiation impedance defined by a ratio between pressure and velocity may be expressed by the following equation (10) if a density of air is $\rho_0$:

$$z_a = \frac{p}{v} = \frac{j\rho_0\omega a}{1 + j\omega a/v_0} \tag{10}$$

Figure 4:
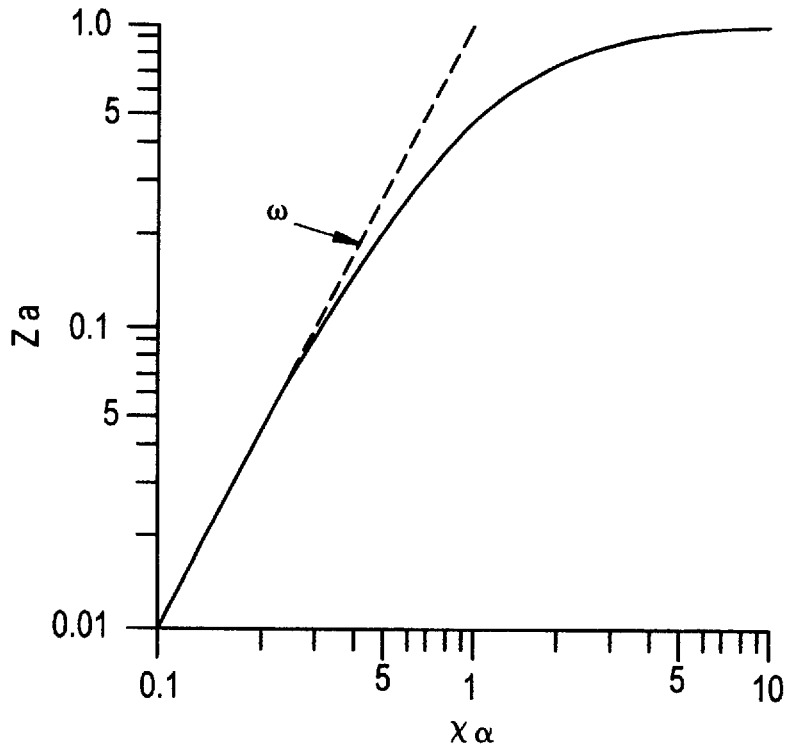
FIG. 4 is a graph showing a frequency characteristic of radiation impedance with respect to a radius in the spherical piezoelectric speaker shown in FIG. 1.
Figure 5:
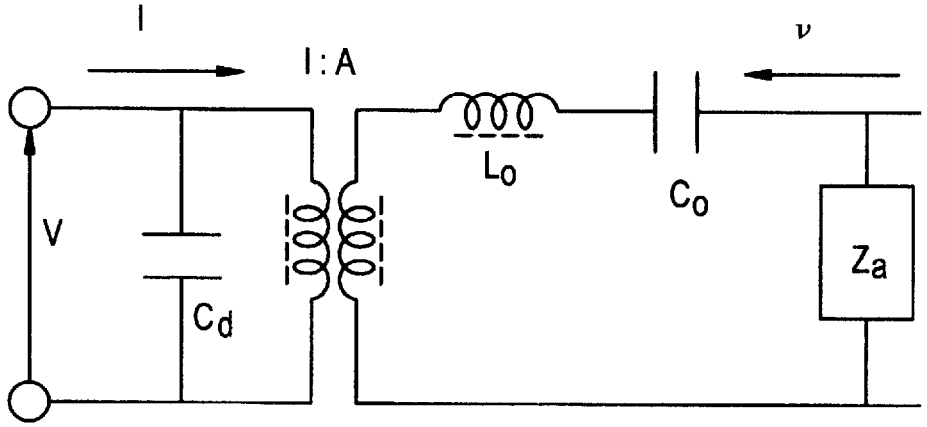
FIG. 5 is an equivalent circuit diagram of the spherical piezoelectric speaker shown in FIG. 1.

A frequency characteristic of this radiation impedance with respect to the radius turns out as shown in FIG. 4. A whole equivalent circuit including the radiation impedance turns out as shown in FIG. 5. Further, a sound pressure at a distance r may be expressed by the following equation (11) in a range where the angular frequency $\omega$ is substantially smaller than the resonance frequency:

$$p \cong -j\omega \frac{d_{31}a^2}{t} \frac{V}{r} Za \tag{11}$$

That is, the sound pressure of the spherical piezoelectric speaker is proportional to $(d_{31}a^2/t)$.

While the basic principle of the inventive spherical piezoelectric speaker has been described above, the inventive spherical piezoelectric speaker will now be explained in detail further based on the following preferred embodiment and by using the drawings, though the present invention is not confined only to the following preferred embodiment.

Figure 6:
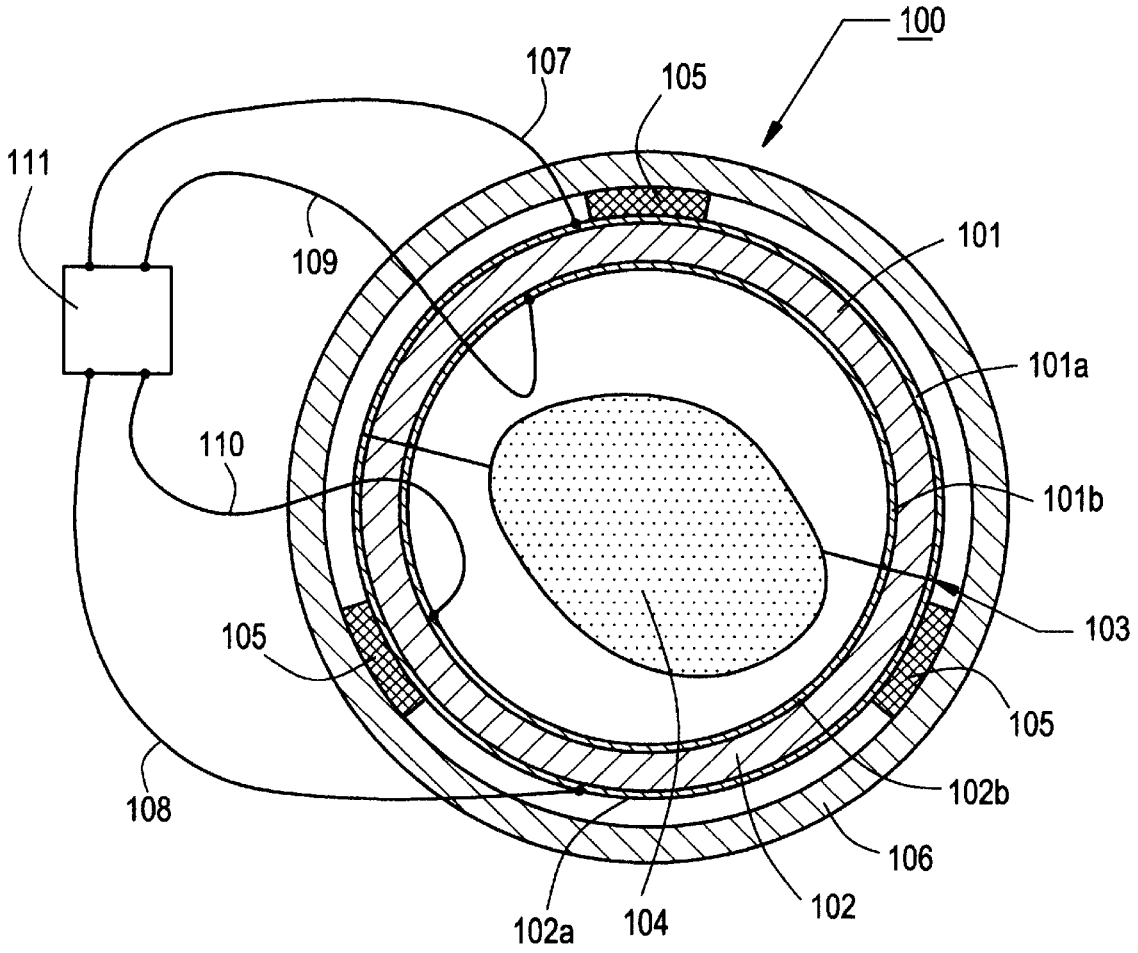
FIG. 6 is a section view showing a structure of a spherical piezoelectric speaker according to still another preferred embodiment of the present invention.

FIG. 6 shows a spherical piezoelectric speaker 100 as still another preferred embodiment of the present invention.

At first, two shell-like semi-spheres 101 and 102 having a radius of about 4 cm and a thickness of about 0.5 mm are created by using a PZT system ceramic material of $\in$=4150, Ks=72 and Qm=70 as a material of the shell-like piezoelectric ceramic body. External electrodes 101*a* and 102*a* and internal electrodes 101*b* and 102*b* mainly composed of silver are formed respectively on the outer and inner surfaces of the semi-spheres 101 and 102 by means of sputtering. Then, after polarizing the shell-like semi-spheres 101 and 102 in the direction of thickness thereof, they are joined together to form a spherical shell piezoelectric ceramic body 103. At this time, glass wool material 104 is provided and concealed in the hollow section of the sphere so as to function as a sound absorber.

The spherical shell piezoelectric ceramic body 103 is held by rubber pads 105 functioning as dampers preferably at three locations on the outer surface thereof and is supported, including the rubber pads 105, by a metallic circular frame 106. The external electrodes 101*a* and 102*a* and the internal electrodes 101*b* and 102*b* are connected respectively with one end of each of lead terminals 107, 108, 109 and 110 whose other ends are connected with a driving unit 111. The spherical piezoelectric speaker 100 is constructed as described above.

Next, characteristics of this spherical piezoelectric speaker 100 will be described below.

Figure 7:
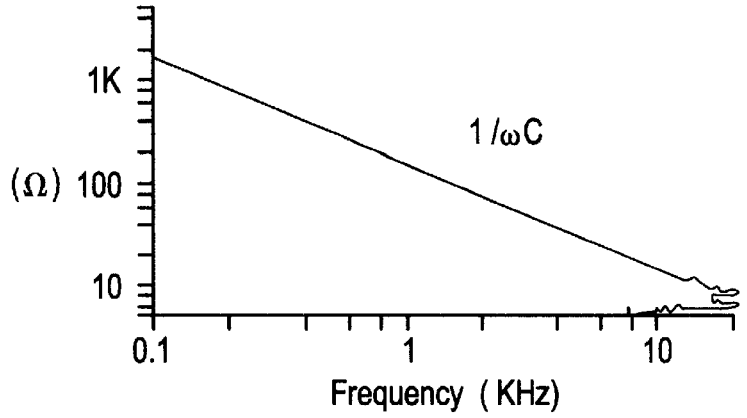
FIG. 7 is graph showing a frequency characteristic of impedance in the spherical piezoelectric speaker shown in FIG. 6.
Figure 8:
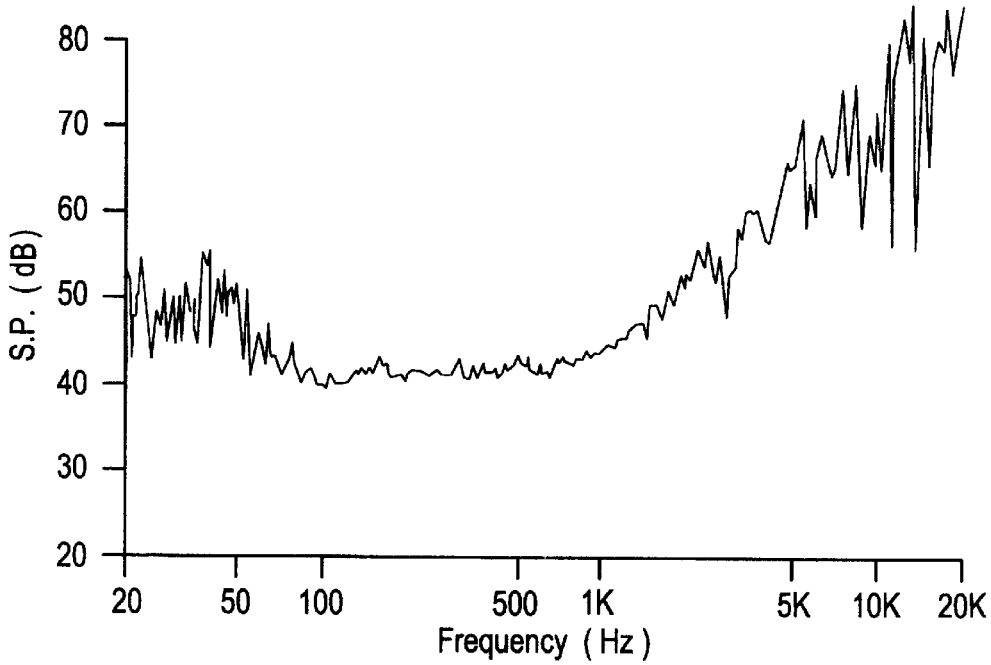
FIG. 8 is graph showing a frequency characteristic of sound pressure in the spherical piezoelectric speaker shown in FIG. 6.

FIG. 7 shows an impedance characteristic and FIG. 8 shows a frequency characteristic of sound pressure of the speaker 100. It is noted that the sound pressure is taken at a distance of 1 m in an anechoic room when a voltage is 2.83 V.

As it can be seen from FIG. 7, impedance of the piezoelectric speaker 100 decreases linearly when the frequency is less than 20 KHz, so that it may be considered as a perfect capacitor. For example, the impedance is 180Ω when the frequency is 1 KHz. When the frequency is 1 KHz, the sound pressure is 46 dB as shown in FIG. 8. Since the sound pressure in prior art is about 20 dB, the sound pressure increases as much as 26 dB in the present invention.

Figure 9:
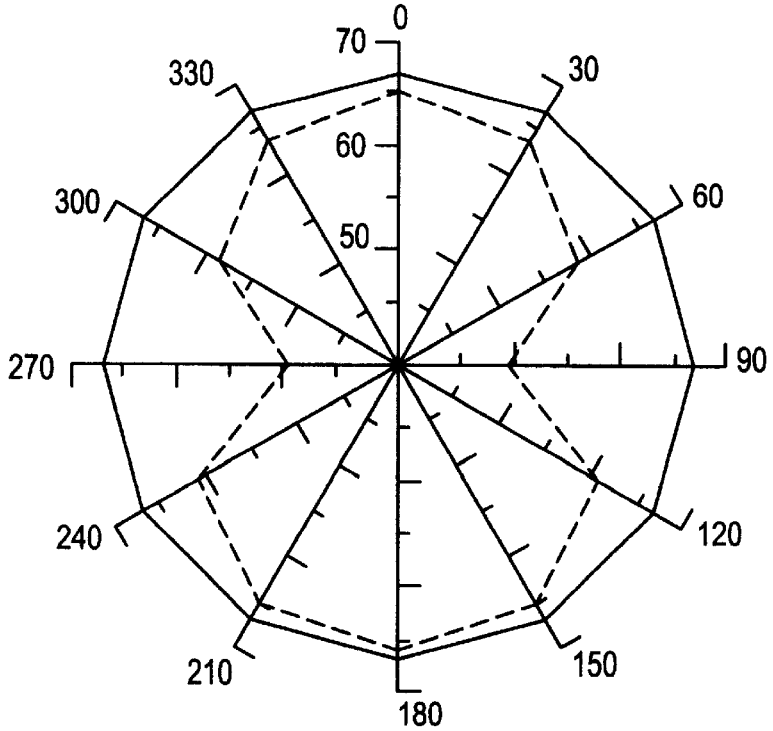
FIG. 9 is an explanatory diagram showing a directivity of the spherical piezoelectric speaker shown in FIG. 6.

FIG. 9 shows a directive characteristic of the sound pressure when the frequency is 1 KHz. In FIG. 9, a solid line indicates a directivity when driving signals having the same phase are inputted in the entire spherical surface and a broken line indicates a directivity when the phase is inverted in the semi-spheres 101 and 102. As is apparent from FIG. 9, the piezoelectric speaker 100 is causing respiratory oscillations in a perfect manner.

Figure 10:
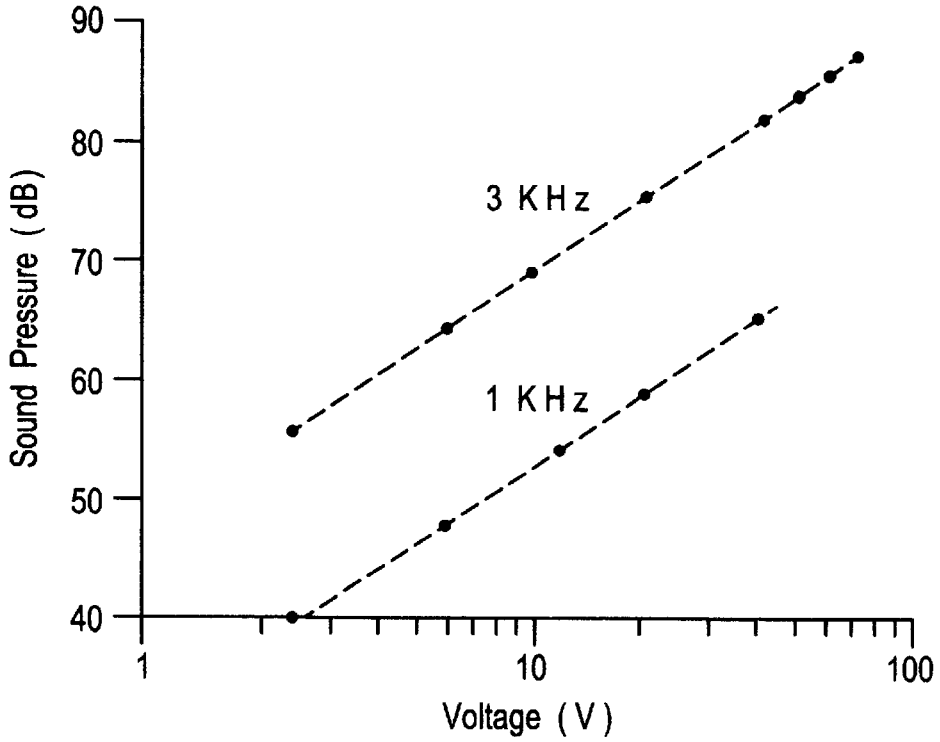
FIG. 10 is a graph showing a sound pressure characteristic, with respect to an input voltage, of the spherical piezoelectric speaker shown in FIG. 6.
Figure 11:
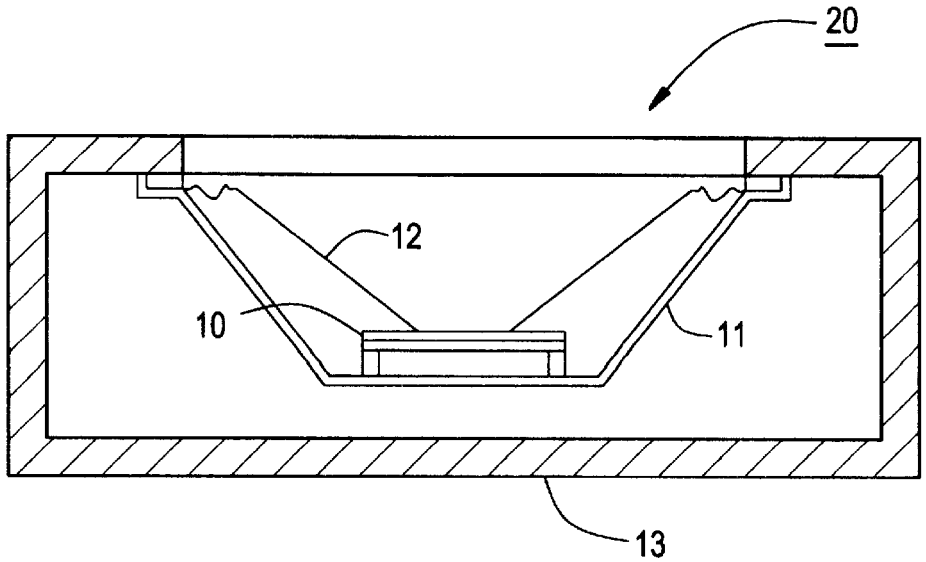
FIG. 11 is a section view showing a prior art piezoelectric speaker.

FIG. 10 shows characteristics of the sound pressure with respect to an input voltage when the frequency is 1 KHz and 3 KHz. It can be seen from this figure that a sound pressure of about 90 dB may be obtained by boosting the input voltage.

As described above, in the inventive spherical piezoelectric speaker, when driving signals are applied to the spherical shell piezoelectric ceramic body, the spherical shell piezoelectric ceramic body causes respiratory oscillation radially from the center thereof. As a result, all of the sound waves output from the surface of the piezoelectric ceramic body have the same phase.

Further, because the sound output from the inner surface of the piezoelectric ceramic body is absorbed by the sound absorber and will not cancel sound waves output from the outer surface of the piezoelectric ceramic body, the overall output sound of the entire speaker is increased.

Further, because the resonance frequency of the spherical shell is inversely proportional to its radius and no resonance is caused in a frequency range below that, sound may be reproduced in a wide frequency range.

Still more, because the speaker box and other parts which have been necessary in the prior art are not necessary, the speaker may be miniaturized.

Although the preferred embodiments of the present invention have been described above, it should be understood that the present invention is not limited thereto and that other modifications will be apparent to those skilled in the art without departing from the spirit of the invention. The scope of the present invention, therefore, should be determined solely by the appended claims.

What is claimed is:

1. A spherical piezoelectric speaker, comprising:

a spherical piezoelectric ceramic body which is hollow inside, the spherical piezoelectric ceramic body including two substantially semispherical piezoelectric ceramic bodies being joined to each other so as to form a substantially complete spherical body adapted to propagate sound waves in all directions, said spherical piezoelectric ceramic body having a continuous outer surface which is interrupted only by two holes each having a diameter substantially equal to a width of a respective lead terminal disposed in each of the two holes; and a driving device for generating sound by oscillating said piezoelectric ceramic body.

2. A spherical piezoelectric speaker according to claim 1, wherein said two holes and said lead terminals are located near at a position where said two substantially semispherical piezoelectric ceramic bodies are joined together.

3. A spherical piezoelectric speaker according to claim 1, further comprising a frame for supporting the spherical piezoelectric ceramic body.

4. A spherical piezoelectric speaker according to claim 3, wherein said frame comprises a ring member completely surrounding the spherical piezoelectric ceramic body.

5. A spherical piezoelectric speaker according to claim 4, further comprising at least one damper located between the frame and the spherical piezoelectric ceramic body.

6. A spherical piezoelectric speaker according to claim 4, wherein the frame is located at a position where the two substantially semispherical piezoelectric ceramic bodies are joined together.

7. A spherical piezoelectric speaker according to claim 1, further comprising a supporting member for supporting the spherical piezoelectric ceramic body, the supporting member being arranged to contact the spherical piezoelectric ceramic body only at an outer surface thereof.

8. A spherical piezoelectric speaker according to claim 1, wherein the spherical piezoelectric ceramic body is adapted and arranged to oscillate symmetrically and radially about a center of the spherical piezoelectric ceramic body so as to propagate sound waves in all directions.

9. A spherical piezoelectric speaker according to claim 1, further comprising a sound absorber disposed in the hollow inside of the spherical piezoelectric ceramic body.

10. A spherical piezoelectric speaker according to claim 1, wherein the spherical piezoelectric ceramic body is polarized in a thickness direction thereof.

11. A spherical piezoelectric speaker according to claim 1, wherein the two substantially semispherical piezoelectric ceramic bodies are each comprised completely of solid piezoelectric material.

12. A piezoelectric speaker comprising:

a piezoelectric ceramic body defining a substantially complete sphere and having a continuous outer surface which is interrupted only by two holes each having a diameter substantially equal to a width of a respective lead terminal disposed in each of the two holes; and a driving a device for generating sound by oscillating said piezoelectric ceramic body; wherein said piezoelectric ceramic body is arranged to oscillate substantially symmetrically about a center of the complete sphere so as to propagate sound waves in all directions.

13. A piezoelectric speaker according to claim 12, wherein the piezoelectric ceramic body includes two semispherical piezoelectric members which are joined to each other to define the complete sphere.

14. A piezoelectric speaker according to claim 12, wherein a phase of each of the sound waves generated by the piezoelectric ceramic body is substantially the same.

15. A piezoelectric speaker according to claim 12, further comprising a supporting member for supporting the piezoelectric ceramic body, the supporting member being arranged to contact the piezoelectric ceramic body only at an outer surface thereof.

16. A piezoelectric speaker comprising:

a piezoelectric ceramic body defining a substantially complete sphere and having a continuous outer surface which is interrupted only by two holes each having a diameter substantially equal to a width of a respective lead terminal disposed in each of the two holes; and a support member disposed around an outer surface of the piezoelectric ceramic body for supporting the piezoelectric ceramic body; and a driving device for generating sound by oscillating the piezoelectric ceramic body.

17. A piezoelectric speaker according to claim 16, wherein the support member comprises a ring-shaped frame completely surrounding the sphere defined by the piezoelectric ceramic body.

18. A piezoelectric speaker according to claim 16, further comprising at least one damper disposed between the piezoelectric ceramic body and the support member.

19. A piezoelectric speaker according to claim 16, wherein the piezoelectric ceramic body includes two semispherical piezoelectric members which are joined to each other to define the complete sphere.

* * * * *